US007446250B1

(12) United States Patent
van der Meulen

(10) Patent No.: US 7,446,250 B1
(45) Date of Patent: Nov. 4, 2008

(54) STAVE CONSTRUCTION METHOD OF DRUM MANUFACTURE

(75) Inventor: Jan Roelof van der Meulen, Brunssum (NL)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 11/742,692

(22) Filed: May 1, 2007

(51) Int. Cl.
*G10D 13/02* (2006.01)

(52) U.S. Cl. ..... 84/411 R

(58) Field of Classification Search ..... 84/411 R, 84/421

See application file for complete search history.

(56) References Cited

U.S. PATENT DOCUMENTS

| | | | | |
|---|---|---|---|---|
| 152,233 | A | | 6/1874 | Kelly |
| 230,829 | A | | 8/1880 | Shear et al. |
| 667,953 | A | | 2/1901 | Ross |
| 700,567 | A | | 5/1902 | Schwab |
| 1,465,215 | A | | 8/1923 | Hall |
| 3,329,174 | A | | 7/1967 | Pfeil |
| 3,462,038 | A | * | 8/1969 | Morris ..... 217/72 |
| 3,667,639 | A | | 6/1972 | Pfeil |
| 4,045,264 | A | | 8/1977 | Ludwig et al. |
| 4,522,006 | A | * | 6/1985 | Plikuhn ..... 52/585.1 |
| 5,301,591 | A | | 4/1994 | Greenberg |
| 5,330,848 | A | | 7/1994 | Kluczynski et al. |
| 5,981,858 | A | | 11/1999 | Jeng |
| 5,987,845 | A | | 11/1999 | Laronde |

* cited by examiner

*Primary Examiner*—Kimberly R Lockett
(74) *Attorney, Agent, or Firm*—Berenato, White & Stavish

(57) ABSTRACT

A percussion instrument, comprising a plurality of wood blocks or staves interlocked to each other through tongue and groove joints, such that the interlocked blocks form a solid surface having the shape of a cylinder with two open ends. A drum head is in contact with one of the open ends of the body, and suitable fixing means, coupled to said head, retain the head under pressure against one of the ends. Preferably, the tongue and groove joints are defined by grooves in the blocks or staves with a spline member disposed in each groove.

12 Claims, 2 Drawing Sheets

STAVE CONSTRUCTION METHOD OF DRUM MANUFACTURE

FIELD OF THE INVENTION

The invention relates to a construction method for a drum body and, more particularly, to method of manufacturing drums using a stave construction system with tongue and groove interlocking members.

DESCRIPTION OF RELATED ART

Drum bodies provide a resonant cavity for the vibrations initiated by the stick hitting the head. Thus, the sound produced depends upon the quality of the body's construction. This is particularly true of congas, bongos, djembes, etc. that are typically made with stave construction. In the case of snare drums, the body determines the nature of the vibrations passing to the head and the snares on the lower side and thus the quality of their tone as well.

The traditional art of solid stave drum shell construction has been used in congas and djembes for many years. A stave drum utilizes a shell made up of multiple segments (or staves). This type of construction not only generates a unique sound, but the use of exotic hardwoods in various combinations creates a striking visual effect as well.

Stave drum shells are made in a method similar to constructing a barrel, where sections of wood are joined by either spline or butting methods which is held by glue. This technique provides phenomenal strength and rigidity while maintaining the tone and response of a solid wood shell. One of the most valuable qualities of a stave drum shell comes from the vertical grain bearing edges which conduct vibration and resonance and sound through the shell far better than any other shell configuration. This method greatly improves the quality of wood in contact with the drum head as hundreds of square inches of glue are eliminated from the process.

Many drum bodies also have a construction of plywood. Typically, the material includes five to seven thin plies of wood glued together with their grains running in crossing directions. Bending the plywood then forms the circular configuration of the body. Shaping the plywood, however, places it under stress. As a result, it displays a lower capacity for transmitting vibrations and thus reduces the desired tone from the drum. It also shows a propensity for interfering with the passage of vibrations from the upper to the lower head of a snare drum.

Furthermore, the glue between the plywood layers also has a tendency to absorb and dampen vibrations from the heads. In particular, the glue also appears at the upper and lower edges upon which rest the heads. This direct contact between the heads and the glues also destroys vibrations that could create the desired tone. In addition, the grain in the several layers of the plywood run at crossing directions. Thus, a strong attack on the drum head creates vibrations in the separate layers which can, in fact, cancel each other. Furthermore, plywood, when placed under the pressure of the heads, can change its shape. This change in shape causes the body to lose some of its capability to transfer and transmit vibrations. Especially do drum bodies losing their shape suffer in their capability of properly transmitting the vibrations for loud tones.

Drum bodies can be made of wood, metal, acrylic plastic, carbon fiber, and other materials. However, wood has been the main choice by builders and drummers alike for many years. Wood produces a warmer tone than metal and is more aesthetically pleasing. Usually, drum bodies made of metal do not satisfy many discerning ears.

In addition, presently available drum bodies have only a limited "sweet" area which gives a desired sound when contacted with the drumstick and properly affects the snares when present. The player, accordingly, must take care not to hit the head outside of this area.

Thus, drum manufacturers have used various types of construction for drum bodies including those discussed above. However, each shows some drawbacks in use. Accordingly, the search for an improved drum body continues.

SUMMARY OF THE INVENTION

The present invention provides a drum body, preferably made from solid wood that avoids many of the problems of the prior bodies. It especially produces a most pleasing tone over a wide range of loudness while providing strength and durability.

In accordance with this invention, a tongue and groove construction is employed to form a drum body. More specifically, a percussion instrument comprises a plurality of blocks interlocked to form a solid surface having the shape of a cylinder with two open ends. Each of the blocks extends from the inside to the outside of the cylinder. A drum head may be in contact with one of the ends of the body; and fixing means, coupled to said head, may retain the drum head under pressure against one of the ends. The blocks are interlocked through a tongue and groove joint extending between the two open ends.

DETAILED DESCRIPTION OF PREFERRED EMBODIMENT

Figure 1:
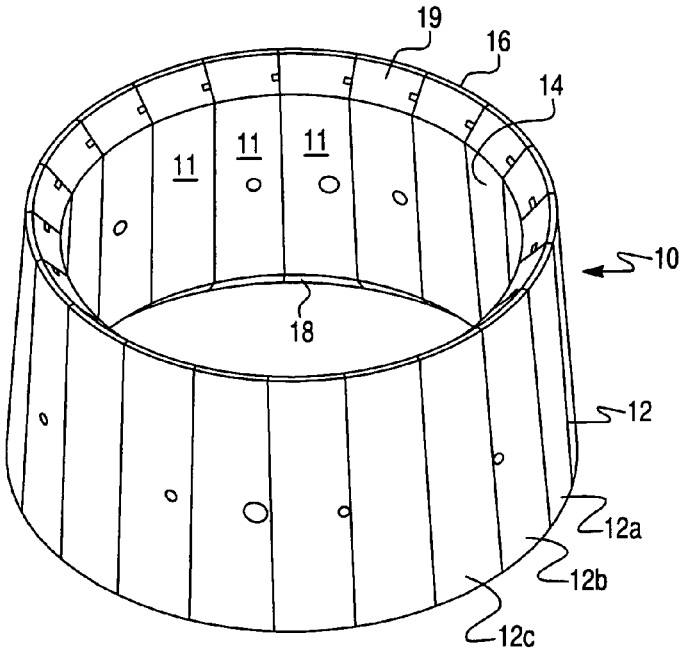
FIG. 1 illustrates a drum body formed according the structure and method of this invention.
Figure 2:
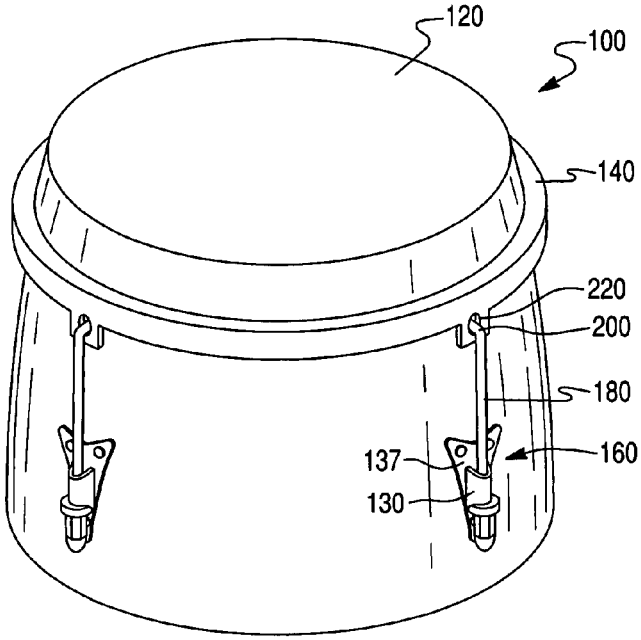
FIG. 2 illustrates a side view of the drum body shown in FIG. 1 with a drum head and mounting hardware partially shown.

A tapered drum shell 10, as shown in FIGS. 1 and 2, forming a specific embodiment of the invention is formed of materials selectively utilized for their resonant quality. These materials may be wood selected from the group consisting of maple, walnut, birch and alder. Other wooden materials and wood composite materials may also be used. Additional, the invention may include rigid plastic, for example, polyvinylchloride, fiber glass, resins, and certain metals. The embodiment depicted in the drawings shows the conical shell 10 and separate staves 12*a*, 12*b*, 12*c*, etc. precisely machined and glued in a vertical manner.

Referring now to the FIG. 2, a conga drum 100 as illustrated for explaining the present invention can, of course, be made in a variety of shapes and from a variety of materials. Each of the drums 100 is constructed to have a drum head 120 composed of skin, or alternately, of synthetic material. The skin is maintained in a conventional manner within a ring 140.

The skin is gripped, whereby tension can be applied for tuning purposes, the tuning being accomplished by reason of tuning mechanisms 160 spaced around the periphery of each of the drums, usually four, five or six in number.

Each of the tuning mechanisms 160, which serve to vary the skin tension completely around the ring 140, includes a rod 180 which is provided, at its upper end, with a hook 200 fitting into an opening 220 in a boss or other hook (see FIG. 2) formed integrally with the ring 140. The rod 180, forming part of the mechanism 160, is received in a tuning bracket or receptacle 130 and extends through the tuning bracket so as to be engaged with a washer and a nut. The nut is selectively moved along the threads of the rod 180 to adjust the tuning of a given drum by applying greater or lesser tension to the head 120 of the drum through the action of ring 140. It will be clear that the tuning bracket 130 is an integral part of a tuning bracket plate 137 which functions to enable attachment of the tuning mechanism 160 by suitable rivets or the like to the shell of the drum. Of course, other types and forms of the tuning bracket performing the same function will be apparent to those of skill in the art.

This embodiment is preferred, however, it is not intended to be limitative. As shown in FIG. 1, the shell 10 has an outside wall 12, an inside wall 14 with a head end 16 and a bottom end 18. Shoulder 19 allows the inside wall 14 to meet the outside wall 12. The head end 16 receives a skin for beating and the bottom end 18 may be open when used as a conga, bongo or similar type of instrument, or the bottom end 18 may be designed as a snare end with snare or wires disposed onto a skin in a known manner to provide for the distinctive sound of a snare drum.

The drum body shown generally at 10 in FIG. 1 includes the multiplicity of solid wood blocks or staves 11 interlocked together. The blocks 11 form rows 12 and give an overall appearance of a cylinder. The layers 12 each forms a plane having a parallel orientation relative to the upper and lower ends of the drum. The block or stave 11 in each row 12 has an elongated vertical orientation relative to the block or stave 11 in any adjacent row. Thus, the blocks 11 form a plurality of parallel staves defining a cylinder.

Figure 3:
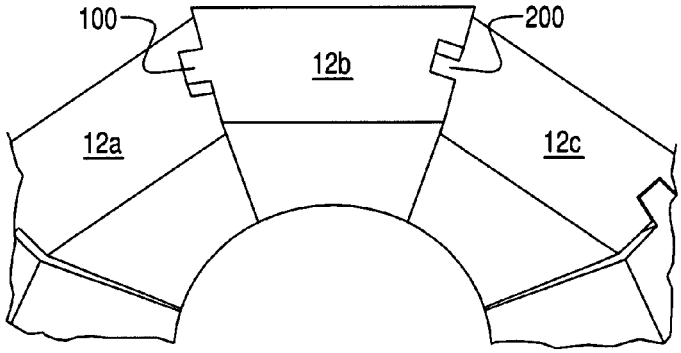
FIG. 3 is a top view of a series of wood blocks or staves formed according to one of the embodiments of the structure and method of the present invention.

With reference to FIG. 3, the tongue-and-groove arrangement of FIG. 1 is clearly illustrated, by way of example, to show each block or stave 11 formed with a tongue-and-groove configuration. With the central stave 12*b* being shown as slightly raised above its adjacent staves 12*a* and 12*c*, it is clear to see that each stave 12*a*, 12*b*, 12*c* is provided with a protruding strip or tongue member 100 and a corresponding groove 200 designed and formed so that the plurality of staves may be mated and glued or otherwise fastened to form the cylindrical shape of a drum body.

Figure 4:
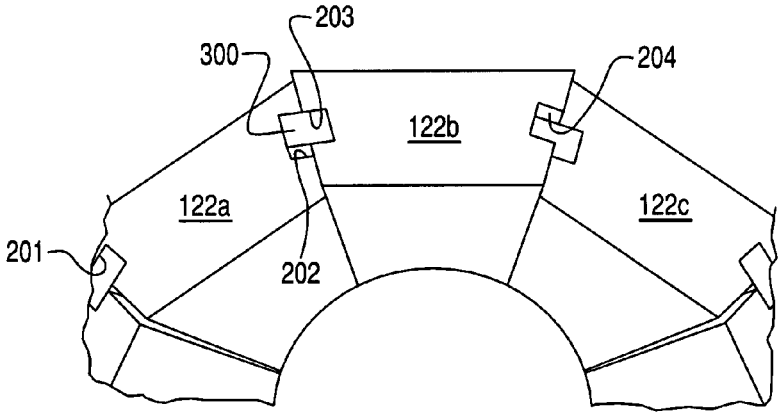
FIG. 4 is a top view of a series of wood blocks or staves formed according to a preferred embodiment of the structure and method of the present invention.
Figure 5:
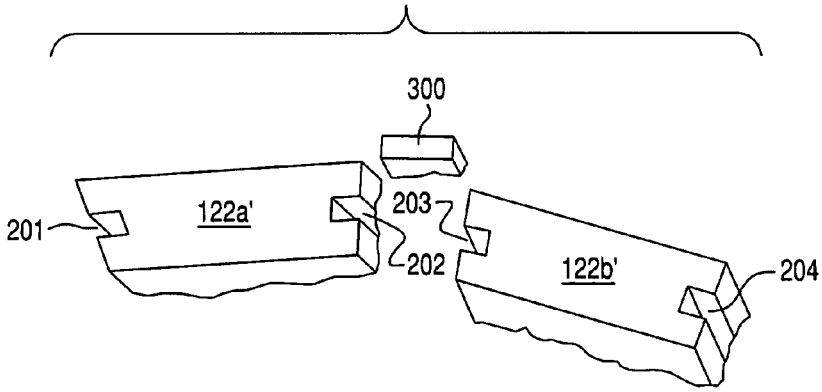
FIG. 5 is an exploded view of the preferred embodiment shown in FIG. 4.

With reference to FIGS. 4 and 5, another embodiment of the tongue and groove arrangement is illustrated to show each stave 122*a*, 122*b*, 122*c* formed with opposing grooves 201, 202, 203, 204 formed in each stave 122*a*, 122*b* with a separate spline member 300 sized to fit into each groove 201, 202, 203, 204 in the same manner as the tongue member 100 shown in FIG. 3. Preferably, the spline member 300 has the same length as the grooves 201-204; however, the invention encompasses an arrangement whereby the splines 300 may be sized for particular applications that might be different in length from the grooves 201-204.

A block or stave 11 preferably remains in an unstressed condition as it forms part of the drum body 10. Yet, to form a solid drum body, the faces of adjoining blocks should make complete contact with each other. This requires the blocks, when viewed from above as shown in FIG. 3, to have a trapezoidal shape. Thus, the two end faces of the particular block do not lie parallel to each other. Rather, they describe the angle between them which actually meets at the center of the drum body 10. The angle represents the number obtained from dividing 360° by the number of blocks in a body 10 describing a complete circle. Placing unstressed blocks 11 into the body 10 results in their grain having their condition that they possessed in the natural state. Typically, that grain lies in the plane determined by the layer in which the block sits. The grain typically runs tangential to the cylindrical surface at the point at which the block has its location.

Typically, the blocks or staves 11 require some form of glue to hold them together. Traditional glues (e.g., wood or aliphatic resin glues) adequately provides that function without having an undue, deleterious effect upon the vibrations within the body 10. Of course, this invention should not be limited to any specific adhesive as would be understood by those of skill in the art.

To find use as a drum, the body 10 must also include the head and hardware which holds a skin or known material in a stretched condition over the end of the body 10. FIG. 2 partially shows one type of hardware typically used in conjunction with a conga-type drum assembly. The hardware only serves to keep the head in a stretched condition. Of course, the present invention applies equally to other types of drum assemblies; e.g., snare, bongos, djembes, etc.

While the invention has been described with respect to the presently preferred embodiment, it will be understood by those skilled in the art after understanding the invention that various changes and modifications in form and detail may be made without departing from the scope of the appended claims.

The invention claimed is:

1. A percussion instrument, comprising:

a plurality of blocks interlocked to form a solid surface having the shape of a cylinder with two open ends, each of said blocks extending from the inside to the outside of said cylinder;

a drum head in contact with at least one of said ends of said body; and fixing means, coupled to said head, for retaining said head under pressure against said one of said ends, wherein at least two of said blocks are interlocked through a vertical tongue and groove joint extending an entire length between said two open ends.

2. A percussion instrument comprising:

a plurality of vertically-oriented blocks interlocked to form a solid surface having the shape of a cylinder with two open ends, each of said blocks extending a distance defined by said two ends;

a drum head in contact with at least one of said ends of said body;

fixing means, coupled to said head, for retaining said head under pressure against said one of said ends, wherein at least two of said blocks are interlocked through a tongue and groove joint extending between said two open ends, and at least one spline member, wherein at least two of said wood blocks comprises a first edge having a first groove extending between said two ends and a second edge having a second groove extending between said two ends, and wherein said spline member is sized to fit within each of said first and second grooves to define said tongue and groove joint.

3. The percussion instrument according to claim 1, wherein each of said two ends of said cylinder defining a substantially flat plane.

4. The percussion instrument according to claim 1, wherein each of said blocks is a solid wood block.

5. A percussion instrument, comprising:

a plurality of solid wood blocks interlocked to form a solid surface having the shape of a cylinder with two open ends, each of said blocks extending from the inside to the outside of said cylinder;

a drum head in contact with at least one of said ends of said body;

fixing means, coupled to said head, for retaining said head under pressure against said one of said ends, wherein at least two of said blocks are interlocked through a tongue and groove joint extending between said two open ends, and wherein each of said wood blocks comprises a first edge having a groove extending between said two ends and a second edge having a protruding strip extending between said two ends.

6. The percussion instrument according to claim 5, wherein said protruding strip of a first wood block is adapted to fit into a complimentary groove provided on an adjacent second wood block.

7. The percussion instrument according to claim 1, wherein said outside of said cylinder has a substantially smooth surface.

8. The percussion instrument according to claim 1, wherein each of said blocks is in a substantially unstressed condition.

9. A percussion instrument, comprising:

a plurality of blocks interlocked to form a solid surface having the shape of a cylinder with two open ends, each of said blocks extending in a vertical direction, wherein each of said two open ends of said cylinder defining a substantially flat plane;

a drum head in contact with at least one of said ends of said body;

fixing means, coupled to said head, for retaining said head under pressure against said one of said ends, wherein each of said blocks are interlocked through vertical tongue and groove joints integrally formed in said plurality of blocks and extending between said two open ends, and wherein said substantially flat planes defined by each of said two ends of said cylinder lie substantially parallel to each other and said blocks are arranged in a plurality of layers with each of said layers lying substantially perpendicular to said substantially flat planes such that each of the tongue and groove joints extend the entire length between said two open ends.

10. The percussion instrument according to claim 1, wherein grain of the wood of each of said blocks is substantially undisturbed from its natural condition.

11. The percussion instrument according to claim 1, wherein each of said blocks is formed from a single integral piece of wood.

12. The percussion instrument according to claim 1, further comprising an adhesive disposed at said tongue and groove joint to adhere each of said blocks together as a unitary assembly.

* * * * *